US009028033B2

(12) United States Patent
Matsuoka

(10) Patent No.: US 9,028,033 B2
(45) Date of Patent: May 12, 2015

(54) PRINTING APPARATUS

(71) Applicant: Canon Kabushiki Kaisha, Tokyo (JP)

(72) Inventor: Yasushi Matsuoka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/019,847

(22) Filed: Sep. 6, 2013

(65) Prior Publication Data

US 2014/0078209 A1 Mar. 20, 2014

(30) Foreign Application Priority Data

Sep. 14, 2012 (JP) ..... 2012-203251

(51) Int. Cl.
*B41J 29/38* (2006.01)
*B41J 11/00* (2006.01)
*B41J 13/00* (2006.01)

(52) U.S. Cl.
CPC ..... *B41J 11/007* (2013.01); *B41J 11/0095* (2013.01); *B41J 13/0045* (2013.01)

(58) Field of Classification Search
USPC ..... 347/5, 14, 16
See application file for complete search history.

(56) References Cited

U.S. PATENT DOCUMENTS

| | | | | |
|---|---|---|---|---|
| 4,983,854 | A * | 1/1991 | Mizuno et al. | 250/559.15 |
| 7,015,474 | B2 * | 3/2006 | Martenson | 250/341.8 |
| 7,114,790 | B2 | 10/2006 | Seki et al. | |
| 2006/0055718 | A1 * | 3/2006 | Endo et al. | 347/14 |
| 2010/0149245 | A1 * | 6/2010 | Yasutani et al. | 347/16 |
| 2012/0081448 | A1 * | 4/2012 | Endo et al. | 347/16 |
| 2013/0208043 | A1 * | 8/2013 | Kawakami et al. | 347/19 |

FOREIGN PATENT DOCUMENTS

JP 2005-74807 A 3/2005

* cited by examiner

*Primary Examiner* — Julian Huffman
*Assistant Examiner* — Sharon A Polk
(74) *Attorney, Agent, or Firm* — Fitzpatrick, Cella, Harper & Scinto

(57) ABSTRACT

In a printing apparatus including a PE sensor which normally functions only in a state in which a sheet is forward-fed, in a case where a printing operation involves back-feeding, the printing apparatus can appropriately manage the length of a sheet and print a desired image. In a case where the printing operation does not include back-feeding, the printing operation is performed based on the result of detection by a first sensor (paper end (PE) sensor), and in the case where the printing operation includes back-feeding, the result of detection by the first sensor is ignored and the printing operation is performed based on only the result of detection by a second sensor.

11 Claims, 7 Drawing Sheets

PRINTING APPARATUS

BACKGROUND OF THE INVENTION

1. Field of the Invention

The present invention relates to a printing apparatus for printing an image on a sheet while checking the presence or absence of the sheet.

2. Description of the Related Art

In many printing apparatuses, a paper end sensor (PE sensor) is provided in a sheet conveying path, and passage of a front end and a rear end of a sheet is detected to manage a printing start position and a printing end position of the printing medium.

Further, Japanese Patent Laid-open No. 2005-74807 discloses a serial inkjet printing apparatus wherein an optical sensor is provided to a side portion of a carriage which moves in a state in which a print head is mounted in the carriage to detect the width of a sheet and a test pattern printed by the print head. More specifically, firstly, a pattern for confirming the width of a printing medium is printed and after it is confirmed that this pattern can be normally detected by the optical sensor, a pattern for adjusting the printing position of the print head is printed and read.

In this manner, various sensors are used to detect the width and length of a sheet, whereby a desired image can be stably output without printing on an area outside the conveyed sheet.

Incidentally, as the above-described PE sensor, a sensor for detecting a front end of a sheet based on rotation of a lever which contacts the sheet and rotates during conveyance of the sheet is widely used because this sensor includes a small number of components and is low in cost.

However, in the PE sensor having the above configuration, in a case where a sheet is back-fed halfway, the lever as well is sometimes returned to an original position, that is, a position where it is determined that a sheet does not exist. In this case, the position of the lever is not changed even by forward-feeding the sheet again thereafter, and the PE sensor cannot accurately detect a rear end of the sheet at the time of passage of the rear end of the sheet. As a result, in a case where a sheet whose length is smaller than the length of an image to be printed is erroneously fed, a print head may print on an area outside the rear end of the sheet to contaminate the inside of the apparatus.

In particular, in a configuration in which the optical sensor is provided upstream of the print head in a conveying direction as disclosed in Japanese Patent Laid-open No. 2005-74807, back-feeding of a sheet is necessary for the optical sensor to detect the test pattern printed by the print head. More specifically, in the configuration disclosed in Japanese Patent Laid-open No. 2005-74807, use of the above-described PE sensor which normally functions only in a forward-feeding state leads to false detection by the PE sensor itself and printing on an area outside a sheet, and it is impossible to perform control properly.

SUMMARY OF THE INVENTION

The present invention is made to solve the above problems. Accordingly, an object of the present invention is to provide a printing apparatus including a PE sensor which normally functions only in a forward-feeding state, wherein the printing apparatus involves back-feeding, but can appropriately manage the length of a sheet and print a desired image.

In a first aspect of the present invention, there is provided a printing apparatus comprising a conveying unit configured to convey a printing medium; a carriage in which a print head is mounted and which moves in a direction crossing a conveying direction of the printing medium; a first sensor which is provided in a printing medium conveying path and which can detect passage of a front end and a rear end of the printing medium; a second sensor which is provided to the carriage and which can detect whether or not the printing medium exists in a printing area of the print head while the carriage moves; and a printing control unit configured to control a printing operation based on results of detection by the first sensor and the second sensor; wherein the printing control unit performs a printing operation based on the result of detection by the first sensor in a case where the printing operation does not include a back-feeding operation and performs a printing operation based on the result of detection by the second sensor in a case where the printing operation includes a back-feeding operation.

In a second aspect of the present invention, there is provided a printing apparatus comprising: a conveying unit configured to convey a printing medium in forward direction and in backward direction; a carriage in which a print head is mounted and which moves in a direction crossing a conveying direction of the printing medium; a first sensor which is provided upstream of the print head in the conveying direction and which can detect a front end and a rear end of the printing medium; a second sensor which is provided to the carriage and which can detect presence or absence of the printing medium; and a control unit configured to perform a printing operation based on a result of detection by the first sensor in a case where the printing operation does not include a back-feeding operation in which the printing medium is conveyed in the back direction, and perform the printing operation based on a result of detection by the second sensor, at least after the back-feeding operation, in a case where the printing operation includes the back-feeding operation.

Further features of the present invention will become apparent from the following description of exemplary embodiments (with reference to the attached drawings).

DESCRIPTION OF THE EMBODIMENTS

Figure 1:
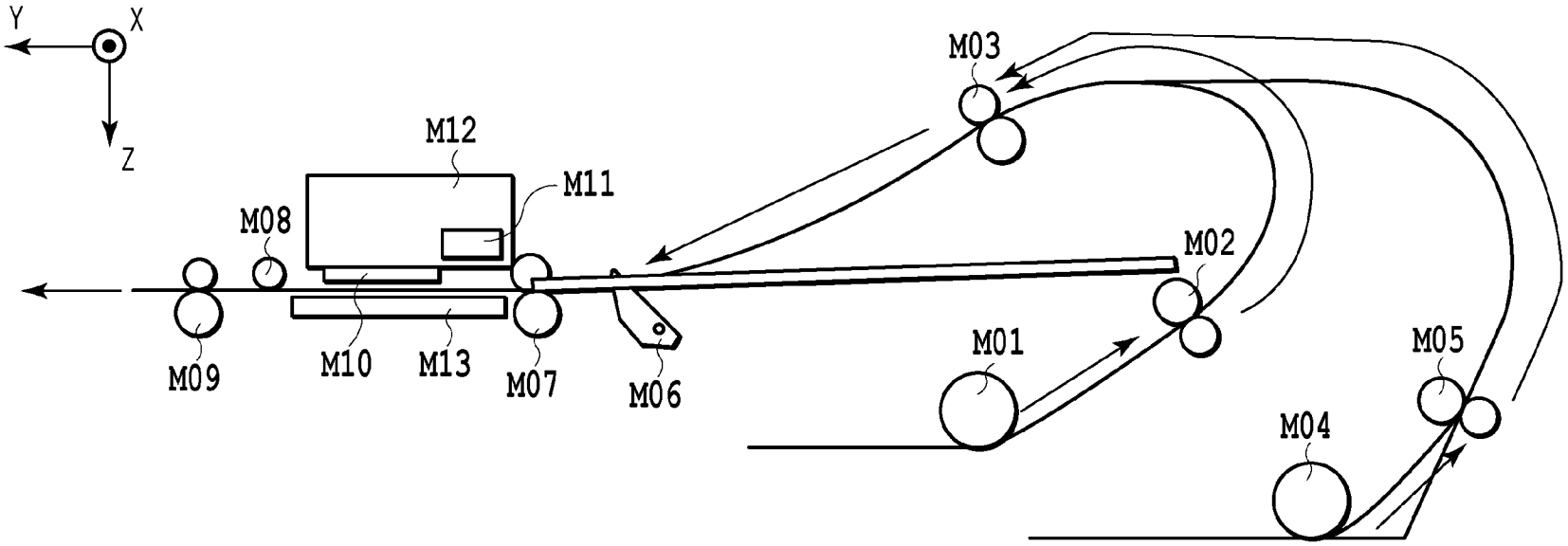
FIG. 1 is a cross-sectional view for explaining a conveying path of a printing apparatus which can be used for the present invention.

FIG. 1 is a cross-sectional view for explaining a conveying path of a printing apparatus which can be used for the present invention. The printing apparatus includes upper and lower cassettes for storing sheets which are printing media to be printed. Relatively small sheets such as the ones having an L size (89 mm×127 mm), a 4×6 size, a postcard size (100 mm×148 mm), a 5×7 size, a 2L size (127 mm×178 mm), or a high-vision size (89 mm×158 mm or 102 mm×181 mm) are stored in the upper cassette. On the other hand, relatively large sheets such as the ones having an LTR size, an A4 size, an LGL size, or a B5 size or envelopes are stored in the lower cassette.

The sheets stored in the upper cassette are fed to the apparatus by a sheet feeding roller M01 for the upper cassette, then pass through a nip portion of first feeding rollers M02, and are conveyed to a nip portion of second feeding rollers M03. Further, the sheets stored in the lower cassette are fed to the apparatus by a sheet feeding roller M04 for the lower cassette, then pass through a nip portion of third feeding rollers M05, and are conveyed to the nip portion of the second feeding rollers M03. After passing through the second feeding rollers M03, the sheets from both the cassettes are conveyed through the same conveying path.

While a sheet is conveyed from a nip portion of conveying rollers M07 to a nip portion of sheet discharging rollers M09, the sheet is supported by a platen M13 from the back side of the sheet to maintain smoothness. In this area, a print head M10 mounted in a carriage M12 ejects ink onto the sheet in a Z direction while reciprocating together with the carriage M12 in a vertical direction (an X direction) in the figure. Such printing movement by the print head M10 and a conveying operation in a Y direction crossing the printing movement direction are alternately repeated, whereby an image is formed on the sheet P in a stepwise manner. In an area which the sheet passes through immediately after printing, a spur M08 prevents the sheet from being bent up. The sheet having passed through the sheet discharging rollers M09 is conveyed in the Y direction as it is, and discharged to the outside of the apparatus.

An optical sensor M11 which is a second sensor of the present embodiment is provided to a side portion of the carriage M12, and measures the reflectivity of the surface of a sheet or the platen M13 which is located right below the optical sensor M11.

Figure 2:
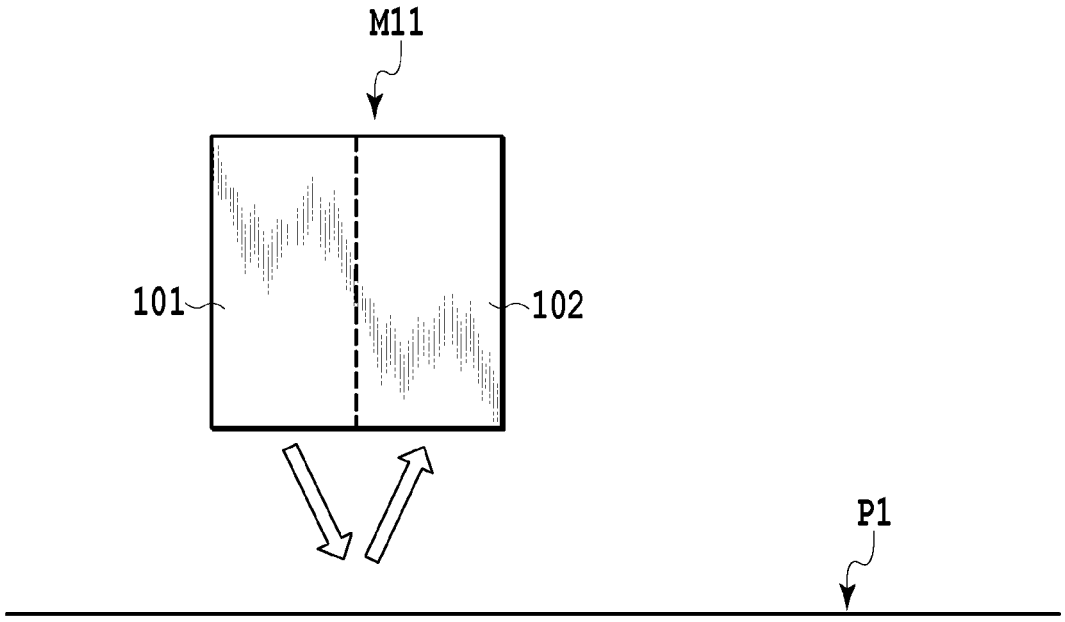
FIG. 2 is a diagram for briefly explaining the configuration of an optical sensor.

FIG. 2 is a diagram for briefly explaining the configuration of the optical sensor M11. The optical sensor M11 is a reflective optical sensor, and includes a light emitting unit 101 and a light receiving unit 102. The light receiving unit 102 detects, as an analog signal, the intensity of reflected light which is reflected after being emitted by the light emitting unit 101. In the present embodiment, light is emitted and received in this manner while the carriage moves. The received analog signal is transferred to a control unit 100 of a main body through a flexible cable and converted into a digital signal by an AD converting circuit.

Figure 3:
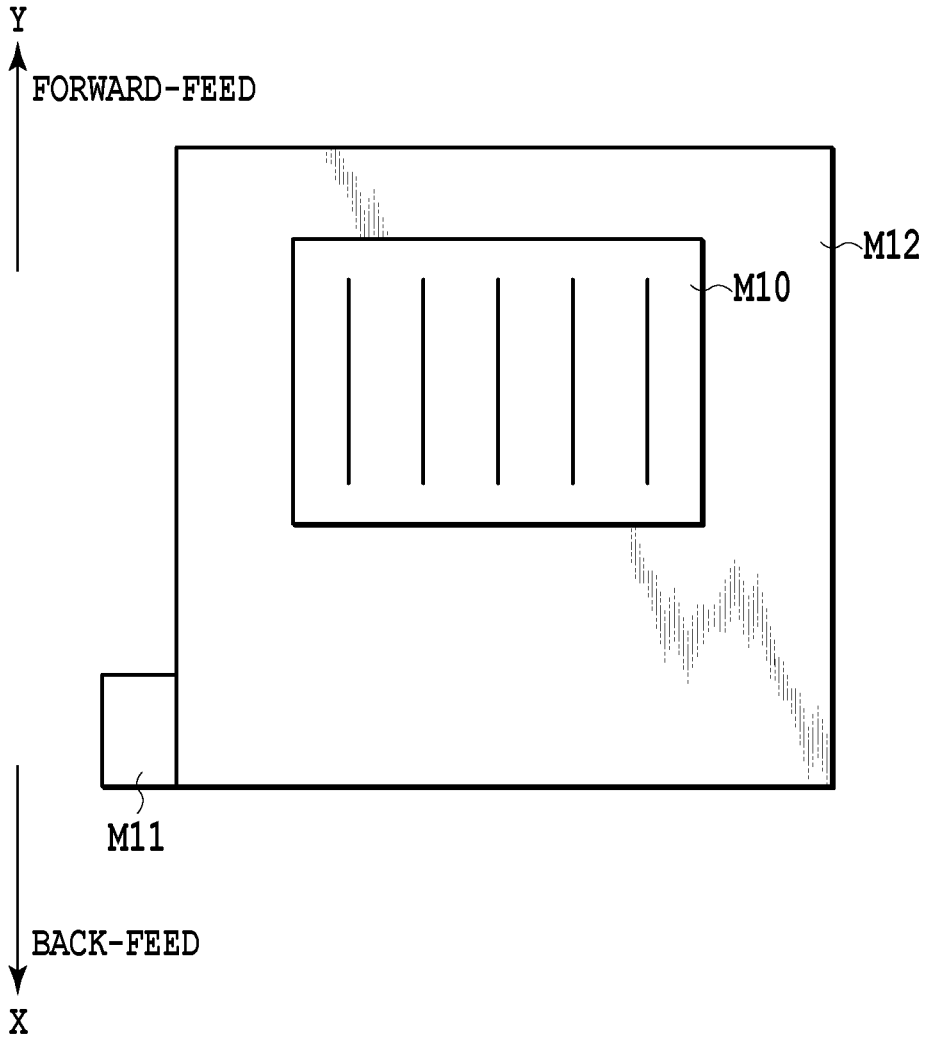
FIG. 3 is a diagram for explaining a positional relationship between a print head and an optical sensor in a carriage.

FIG. 3 is a diagram for explaining a positional relationship between the print head M10 and the optical sensor M11 in the carriage M12. The optical sensor M11 is displaced from the print head M10 in the Y direction in order not to be directly affected by a mist of ink ejected from the print head M10. In the present embodiment, the optical sensor M11 is located upstream of a printing area of the print head M10 in the conveying direction (Y direction). In this configuration, it is necessary to back-feed a printed sheet in a direction opposite to the Y direction so that the optical sensor M11 detects an area printed by the print head M10.

Referring back to FIG. 1, a PE sensor M06 which is a first sensor of the present embodiment is provided between the second feeding rollers M03 and the conveying rollers M07, and detects front and rear ends of a sheet which passes through the PE sensor M06.

Figure 4A:
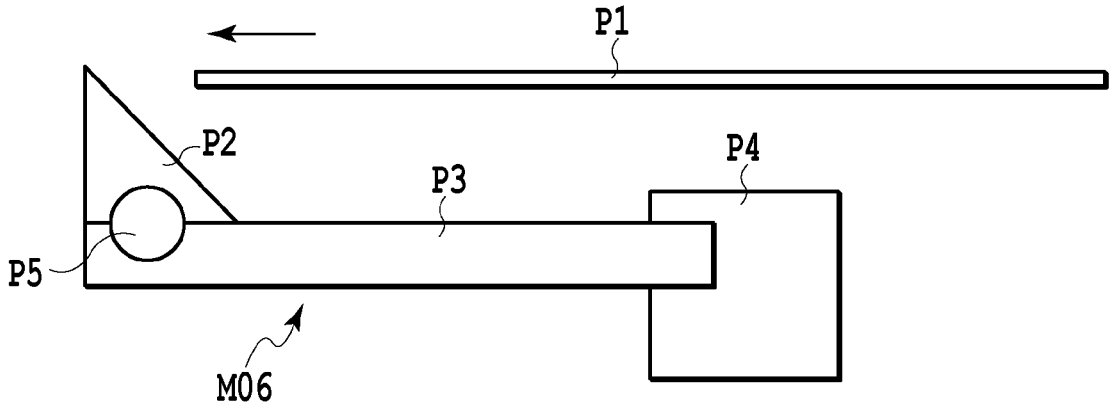
FIGS. 4A and 4B show a state in which a PE sensor detects a front end of a sheet.
Figure 4B:
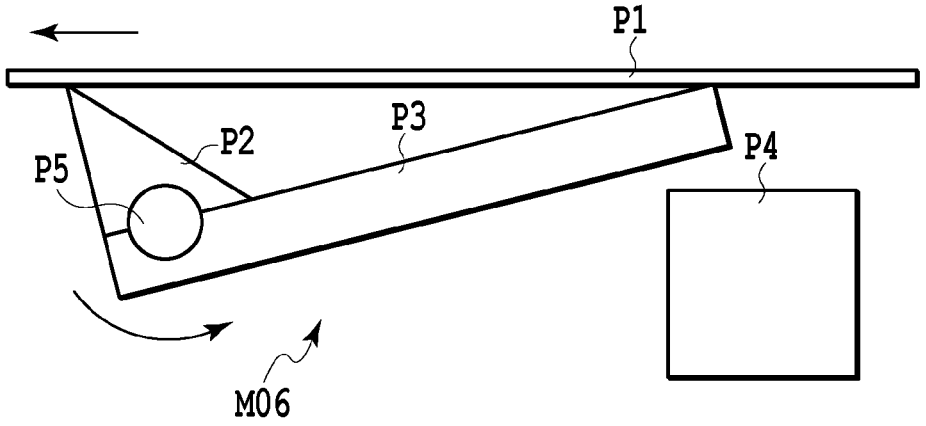

FIGS. 4A and 4B show a state in which the PE sensor M06 detects a front end of a conveyed sheet P1. In the PE sensor M06, a lever P3 including a trigger portion P2 can rotate about a rotation axis P5 and blocks light for or releases a determining unit P4 fixed in the apparatus according to the rotation position of the lever P3. Before the sheet P1 reaches the PE sensor M06, the PE sensor M06 is in a position shown in FIG. 4A and the lever P3 blocks light for the determining unit P4. Based on this state, the determining unit P4 determines that "a sheet does not exist".

On the other hand, in a case where the sheet P1 is conveyed in the Y direction and a front end of the sheet P1 contacts the trigger portion P2 which protrudes from a sheet conveying path, the trigger portion P2 is pressed down by contact force of the sheet and the lever P3 rotates counterclockwise as shown in FIG. 4B. In this manner, the lever P3 is separated from the determining unit P4, so that the lever P3 does not block light for the determining unit P4. Based on this state, the determining unit P4 determines that "a sheet exists". Thereafter, in a case where a rear end of the sheet passes through the trigger portion P2, the lever P3 rotates clockwise and returns to the position indicating that "a sheet does not exist" as shown in FIG. 4A.

In this manner, in a state in which the sheet P1 is conveyed in the normal conveying direction (Y direction), that is, the sheet P1 is forward-fed, the PE sensor changes its position in response to passage of the front end or the rear end of the sheet to correctly determine that "a sheet does not exist" or that "a sheet exists".

Figure 5A:
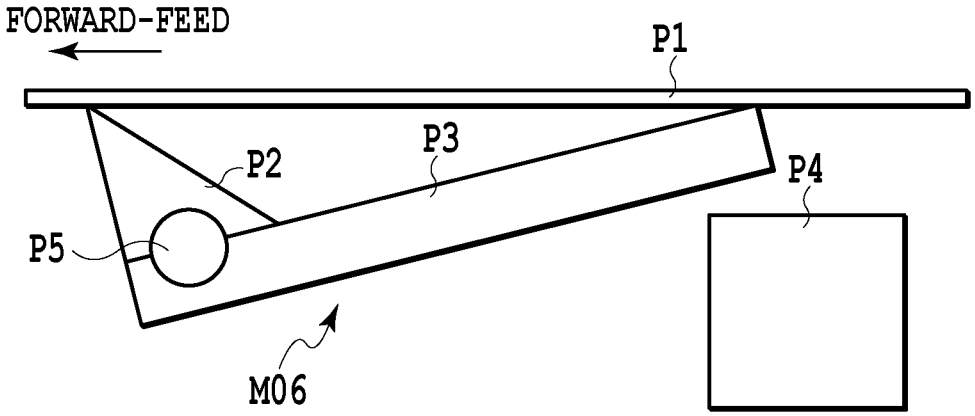
FIGS. 5A and 5B show the state of the PE sensor respectively during forward-feeding and back-feeding of a sheet.
Figure 5B:
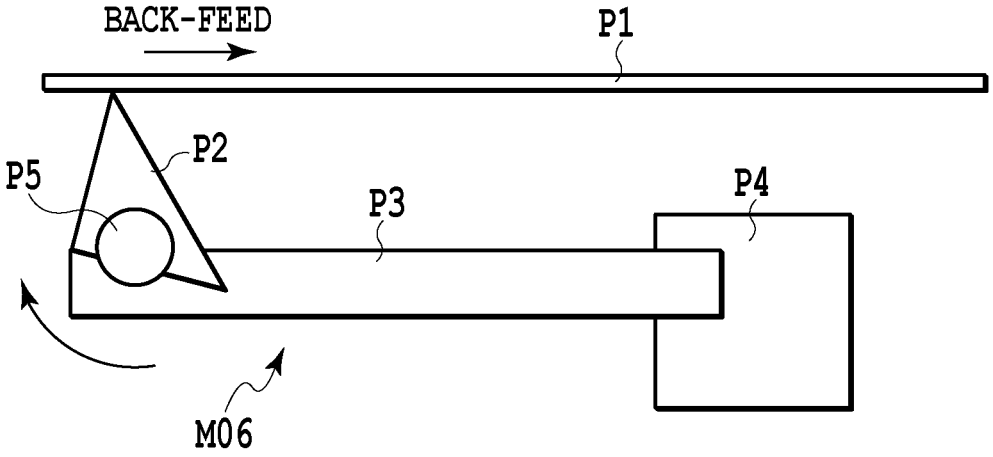

FIGS. 5A and 5B show the states of rotation of the PE sensor M06 in a case a sheet is forward-fed and a case where the sheet is back-fed halfway.

The PE sensor M06 rotated by a front end of the sheet is kept in a position indicating that "a sheet exists" as shown in FIG. 5A while the sheet is forward-fed. However, in a case where the sheet is back-fed, the trigger portion P2 is urged to rotate in an opposite direction and the PE sensor M06 returns to a position indicating that "a sheet does not exist" as shown in FIG. 5B. Once the PE sensor M06 returns to this position, force applied to the trigger portion P2 is not so large irrespective of whether the sheet P1 is conveyed forward or backward. Accordingly, until a front end of a next sheet applies contact force to the trigger portion P2 in a forward direction, the PE sensor M06 is kept in a position shown in FIG. 5B.

Figure 6:
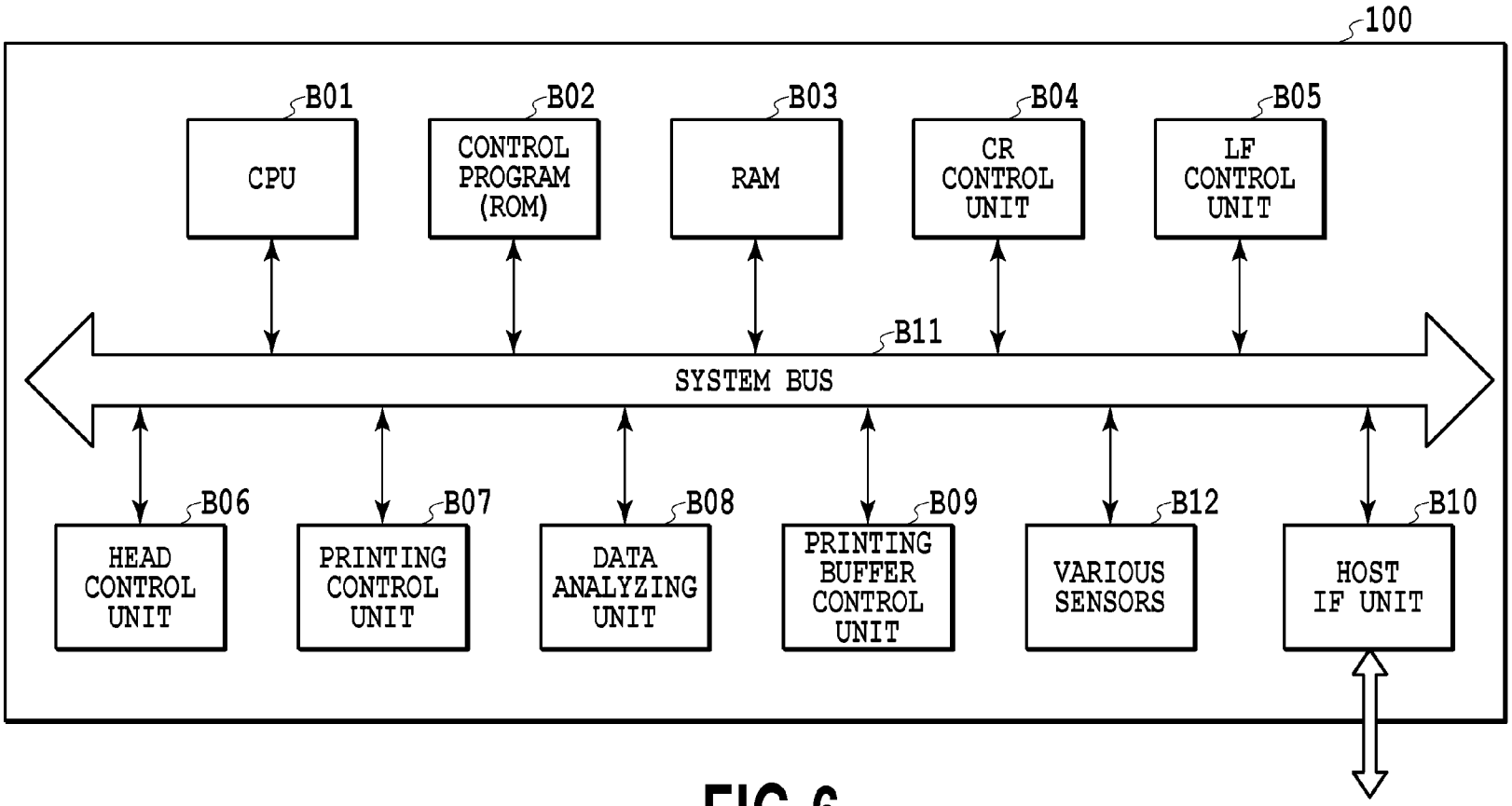
FIG. 6 is a block diagram for explaining the control configuration of the printing apparatus.

FIG. 6 is a block diagram for explaining the control configuration of the printing apparatus of the present embodiment.

Figure 7:
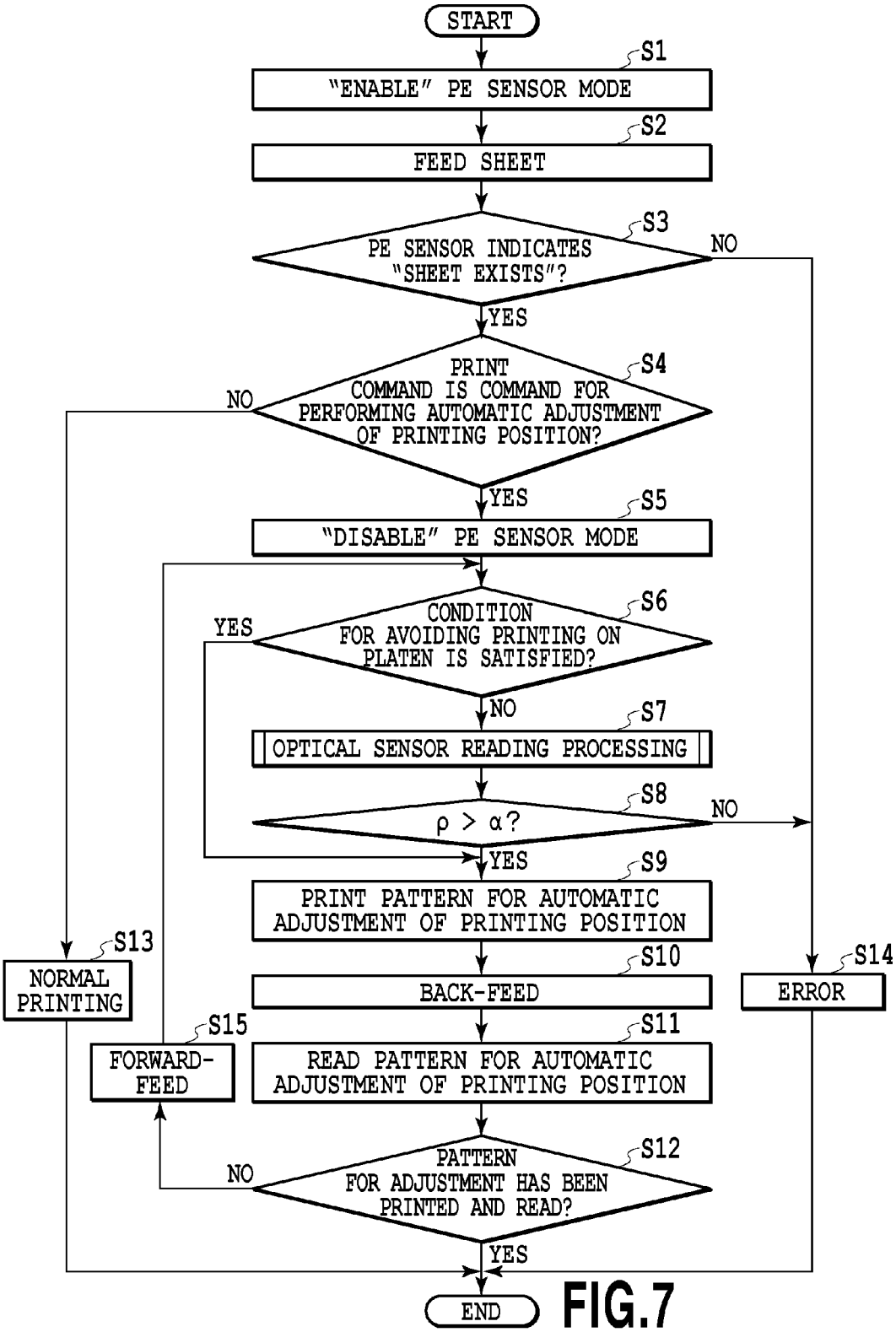
FIG. 7 is a flowchart for explaining a printing sequence.

A central processing unit (CPU) B01 controls the entire printing apparatus according to a control procedure program or the like which is stored in a read-only memory (ROM) B02 and whose example is shown in, for example, FIG. 7 which is a flowchart. On this occasion, a random access memory (RAM) B03 is used as a work area of the CPU B01 and a memory area for storing data received by a host I/F unit B10 or as a memory area for temporarily storing image data.

A CR control unit B04 controls driving of a carriage motor for reciprocating the carriage M12 in the X direction. In order to convey the sheet P1 in a forward or backward direction, an LF control unit B05 controls driving of an LF motor to rotate the sheet feeding rollers M01, M04, the first feeding rollers M02, the second feeding rollers M03, the third feeding rollers M05, the conveying rollers M07, and the sheet discharging rollers M09.

The host I/F unit B10 transmits and receives information to and from a host device connected to the outside (for example, receives image data or provides apparatus information). A data analyzing unit B08 analyzes the content of image data received through the host I/F unit B10, and the CPU B01 gives instructions to perform predetermined image processing, and thereafter, the image data is stored in the RAM B03. On this occasion, a printing buffer control unit B09 manages a memory area in the RAM (B03).

A printing control unit B07 transfers printing data to a head control unit B06 for directly driving the print head M10 based on printing data stored in the RAM B03 and controls the CR control unit B04 and the LF control unit B05.

The head control unit B06 is electrically connected to the print head M10 and controls the temperature of the print head M10 and causes the print head M10 to eject ink according to the printing data received from the printing control unit B07.

Various sensors B12 include the PE sensor M06 and the optical sensor M11 which have already been explained, a temperature sensor for detecting the temperature of the print head and an environmental temperature, and the like. The CPU B01 controls various mechanisms according to various types of information detected by the above sensors to smoothly perform a printing operation or report an error.

The above-explained constituent units and components are connected to the CPU B01 via a system bus B11.

Hereinafter, the features of the present invention will be explained.

FIG. 7 is a flowchart for explaining a printing sequence to be performed by the CPU B01.

On receiving a print command via the host I/F B10, the CPU B01 "enables" a PE sensor mode in step S1. Then, the CPU B01 drives various sheet feeding motors and conveying motors based on a designated sheet size to convey a sheet from a predetermined cassette to the apparatus (step S2).

In step S3, the CPU B01 determines whether or not the PE sensor M06 indicates that "a sheet exists" because of step S2 which is the sheet feeding step. In a case where the PE sensor M06 indicates that "a sheet does not exist", the process proceeds to step S14 to notify a user of a sheet feeding error and thereafter, the process ends. On the other hand, in a case where the PE sensor M06 indicates that "a sheet exists", the process proceeds to step S4.

In step S4, it is determined whether or not the print command is a command for performing automatic registration adjustment. Automatic adjustment of a printing position corresponds to adjustment of a dot position disclosed in Japanese Patent Laid-open No. 2005-74807, and the print head prints a test pattern and the optical sensor scans and reads the test pattern to detect the amount of printing position displacement of the print head and automatically correct the printing position displacement. In a case where the print command is not a command for performing automatic adjustment of a printing position in step S4, the process proceeds to step S13 to perform a normal printing operation. More specifically, a printing operation by the print head M10 and a sheet conveying operation are repeated based on information obtained from the PE sensor M06 and indicating that "a sheet exists" or that "a sheet does not exist" to print predetermined printing data on an inner area of the sheet. After the sheet is discharged, the process ends.

On the other hand, in a case where it is determined that the print command is the command for performing automatic adjustment of a printing position in step S4, the process proceeds to step S5.

In step S5, the CPU B01 "disables" the PE sensor mode. More specifically, thereafter, switching between information indicating that "a sheet exists" and information indicating that "a sheet does not exist" is not made in response to a change in the position of the PE sensor M06, and the currently-shown information indicating that "a sheet exists" is maintained until the PE sensor mode is "enabled" again.

In next step S6, it is determined whether or not the test pattern printed for automatic adjustment of a printing position satisfies a condition for avoiding printing on the platen. Here, the condition for avoiding printing on the platen is that "a distance between an area to be printed by next printing movement and a front end of the sheet is equal to or smaller than L". L is a distance between the PE sensor M06 and the printing area of the print head (in this case, 154.98 mm). In a case where this condition is satisfied, it is found that an area to be printed by next printing movement was positioned between the print head M10 and the PE sensor M06 at the time when the feeding operation in step S2 was completed. More specifically, the area to be printed by next printing movement is located downstream of a position where the PE sensor M06 determines that "a sheet exists" while the PE sensor mode is "enabled" (in other words, a position which is the distance L away from the front end), and accordingly, the rear end of the sheet does not exist in the area to be printed by next printing movement. In other words, in a case where the above condition is satisfied, it is ensured that next printing and scanning will be performed on the sheet and that printing will not be directly performed on the platen M13.

Accordingly, in a case where the condition for avoiding printing on the platen is satisfied in step S6, it is not necessary to detect the presence or absence of the sheet again and the process jumps to step S9. On the other hand, in a case where the condition for avoiding printing on the platen is not satisfied, the process proceeds to step S7 to detect the presence or absence of the sheet by using the optical sensor M11.

In step S7, the CPU B01 obtains a detection value from the optical sensor M11 while moving the carriage M12 in the X direction. More specifically, an analog signal value received by the light receiving unit 102 during moving is converted into a digital signal value, and an average reflectivity $\rho$ is calculated from reflectivities at positions in the moving direction.

In step S8, based on the average reflectivity $\rho$ obtained in step S7, it is determined whether or not the sheet exists in a scanning area. Normally, the reflectivity of the sheet is higher than that of the platen M13. Accordingly, in the present embodiment, a threshold reflectivity $\alpha$ is previously prepared to distinguish the reflectivity of the sheet from that of the platen M13. In a case where the average reflectivity $\rho$ is equal to or larger than the threshold $\alpha$, it is determined that "the sheet exists", and in a case where the average reflectivity $\rho$ is smaller than the threshold $\alpha$, it is determined that "the sheet does not exist". In a case where in step S8, it is determined that "the sheet does not exist", an error is reported in step S14, and the process ends. On the other hand, in a case where it is determined that "the sheet exists", the process proceeds to step S9.

In step S9, a predetermined amount of a test pattern for automatic adjustment of a printing position is printed. Further, in step S10, the sheet is back-fed to a position where the optical sensor M06 can read the pattern printed in step S9, and in step S11, the optical sensor scans the pattern.

In next step S12, it is confirmed whether the test pattern for automatic adjustment of a printing position has been printed and read. In a case where it is determined that the test pattern has been printed and read, the sheet is discharged, and the process ends. On the other hand, in a case where it is determined that an unprinted pattern still remains, the sheet is forward-fed to a position where the next pattern is to be printed in step S15, and the process returns to step S6 to print the next pattern.

As explained above, in the present embodiment, immediately before a printing operation is performed in a printing position automatic adjustment mode, the result of detection by the PE sensor is disabled, and thereafter, the presence or absence of the sheet is confirmed by using the optical sensor provided to the side portion of the carriage during printing.

This makes it possible to reliably perform printing on the sheet while checking the presence or absence of the sheet even during a printing operation including back-feeding. Even in a case where a sheet whose length is smaller than the length of an image to be printed is erroneously fed, it is possible to avoid printing on the platen.

Incidentally, in the above embodiment, the printing position automatic adjustment mode is used as an example of the printing operation including back-feeding. However, the present invention is not limited to this. Back-feeding is performed in various cases such as a case where a printing mode or a nozzle array to be used in the print head is changed during printing on a sheet. In any case, the present invention can satisfactorily achieve its advantageous results as long as detection by the PE sensor is disabled before performing a printing operation which involves back-feeding, and thereafter, the optical sensor provided to the side portion of the carriage detects the presence or absence of a sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-203251, filed Sep. 14, 2012, which is hereby incorporated by reference herein in its entirety.

What is claimed is:

1. A printing apparatus comprising:

a conveying unit configured to convey a printing medium in conveying directions including a forward conveying direction and a backward conveying direction;

a carriage to which a print head is mounted and which moves in a direction crossing the conveying directions;

a first sensor which is provided in a printing medium conveying path;

a second sensor which is provided on the carriage; and a control unit configured to control a printing operation, wherein in a case where the printing operation does not include a back-feeding operation, the control unit controls the printing operation based on a result of detection by the first sensor, and in a case where the printing operation includes a back-feeding operation, the control unit controls the printing operation based not on the result of detection by the first sensor but based on a result of detection by the second sensor.

2. The printing apparatus according to claim 1, wherein the printing control unit controls a feeding operation for feeding the printing medium based on the result of detection by the first sensor before controlling the printing operation.

3. The printing apparatus according to claim 1, wherein the first sensor detects passage of a front end and a rear end of the printing medium based on a change in a position of the first sensor caused by contact with the printing medium, and the second sensor detects the presence or absence of the printing medium by measuring a reflectivity at a position through which the printing medium passes.

4. The printing apparatus according to claim 1, wherein the second sensor detects the presence of the printing medium and a pattern printed on the printing medium to adjust the printing apparatus.

5. The printing apparatus according to claim 1, wherein the second sensor is positioned on the carriage upstream of the print head with respect to the forward conveying direction.

6. A printing apparatus comprising:

a conveying unit configured to convey a printing medium in conveying directions including a forward conveying direction and in a backward conveying direction;

a carriage to which a print head is mounted and which moves in a direction crossing the conveying direction;

a first sensor which is provided upstream of the print head with respect to the forward conveying direction;

a second sensor which is provided on the carriage; and a control unit configured to control a printing operation, wherein, in a case where the printing operation does not include a back-feeding operation, the control unit controls the printing operation based on a result of detection by the first sensor, and in a case where the printing operation includes a back-feeding operation, the control unit controls the printing operation, at least after the back-feeding operation, based not on the result of detection by the first sensor but based on a result of detection by the second sensor.

7. The printing apparatus according to claim 6, wherein the control unit recognizes a rear end of the print medium based on the result of detection by the first sensor in the case where the printing operation does not include the back-feeding operation and recognizes the rear end of the print medium based on the result of detection by the second sensor in the case where the printing operation includes the back-feeding operation.

8. The printing apparatus according to claim 6, wherein the first sensor is provided in a printing medium conveying path opposite to the print head on a reverse side of the printing medium.

9. The printing apparatus according to claim 6, wherein the first sensor detects passage of a front end and a rear end of the printing medium based on a change in a position of the first sensor caused by contact with the printing medium, and the second sensor detects presence or absence of the printing medium by measuring a reflectivity at a position through which the printing medium passes.

10. The printing apparatus according to claim 6, wherein the second sensor detects presence or absence of the printing medium and a pattern printed on the printing medium to adjust the printing apparatus.

11. A printing apparatus comprising:

a conveying unit configured to convey a printing medium in conveying directions including a forward conveying direction and a backward conveying direction;

a carriage to which a print head is mounted and which moves in a direction crossing the conveying directions;

a first sensor which is provided upstream of the print head with respect to the forward conveying direction;

a second sensor which is provided on the carriage; and a control unit configured to control a printing operation, wherein, in a case where the printing operation does not include a back-feeding operation, the control unit controls the printing operation based on front end information detected by the first sensor and rear end information detected by the first sensor, and in a case where the printing operation includes a back-feeding operation, the control unit controls the printing operation based on the front end information detected by the first sensor and rear end information detected by the second sensor.

* * * * *